United States Patent [19]

Ott et al.

[11] 4,002,475

[45] Jan. 11, 1977

[54] PHOTOCONDUCTIVE PROCESS FOR MAKING ELECTROGRAPHIC MASTERS

[75] Inventors: Robert J. Ott, Rochester; Hans G. Franke, Hilton, both of N.Y.

[73] Assignee: Eastman Kodak Company, Rochester, N.Y.

[22] Filed: May 5, 1975

[21] Appl. No.: 574,204

[52] U.S. Cl. ..... 96/1 E; 204/181; 204/18 PC

[51] Int. Cl.[2] ..... G03G 13/22; B44C 1/04

[58] Field of Search ..... 96/1 R, 1 E; 204/18 PL, 204/181 R

[56] References Cited

UNITED STATES PATENTS

| | | | |
|---|---|---|---|
| 2,530,366 | 11/1950 | Gray | 204/181 R |
| 3,010,883 | 11/1961 | Johnson et al. | 96/1 E X |
| 3,011,918 | 12/1961 | Silvernail et al. | 96/1 E X |
| 3,106,155 | 10/1963 | Eastman et al. | 96/1 E X |
| 3,127,331 | 3/1964 | Neher | 204/18 PC |
| 3,172,826 | 3/1965 | Tulagin et al. | 204/18 PC |
| 3,178,362 | 4/1965 | Sagura et al. | 204/18 PC |
| 3,288,770 | 11/1966 | Butler | 260/88.3 |
| 3,384,560 | 5/1968 | Reithel | 204/18 PC |
| 3,402,111 | 9/1968 | Ville | 96/1 E X |
| 3,425,829 | 2/1969 | Cassiers et al. | 96/1 R |
| 3,436,215 | 4/1969 | Levinos et al. | 96/1 R |
| 3,444,065 | 5/1969 | Strosberg | 204/181 R |
| 3,550,153 | 12/1970 | Haeberle et al. | 346/74 |
| 3,615,414 | 10/1971 | Light | 96/1 R X |
| 3,663,389 | 5/1972 | Koral et al. | 204/181 R |
| 3,676,116 | 7/1972 | Krohn et al. | 96/1 M |
| 3,676,215 | 7/1972 | Gundlach | 96/1 LY X |
| 3,862,841 | 1/1975 | Pilato et al. | 96/1 R |

FOREIGN PATENTS OR APPLICATIONS

| | | | |
|---|---|---|---|
| 682,268 | 3/1964 | Canada | 96/1 E |
| 1,006,115 | 9/1965 | United Kingdom | |

*Primary Examiner*—Roland E. Martin, Jr.
*Attorney, Agent, or Firm*—G. W. Neuner

[57] ABSTRACT

A method of photoconductivity attracting cationic resins in an imagewise fashion to a photoconductor, wherein the photoconductor in contact with the resin is biased positively. The resultant resin negative permits the resin coated photoconductor to be used as a master for electrographic copying.

11 Claims, 2 Drawing Figures

PHOTOCONDUCTIVE PROCESS FOR MAKING ELECTROGRAPHIC MASTERS

BACKGROUND OF THE INVENTION

1. Field of the Invention

This invention relates to a photoconductive process of coating a photoconductive member with a resin to form a negative image suitable for use in electrographic copying, such as xeroprinting.

2. State of the Prior Art

Photoconductors have long been used to print a large number of copies from a persistent image formed thereon.

To improve upon the quality of images formed by processes such as xerography, one technique has been to form, by photoconductography, a coating of an ionic electrolyte over a photoconductor, the electrolyte being electrically attracted to the oppositely biased-photoconductor surface upon imagewise exposure of the interface. The result is the formation of a negative image which can be used to form a positive image by applying a developer to the areas of the photoconductor not imagewise covered by the electrolyte. A representative patent illustrating this approach is U.S. Pat. No. 3,178,362.

Such photoconductive process has been limited, not surprisingly, to the use of electrolytes having a net charge which is opposite in sign to the bias imposed on the photoconductor. In those instances in which the preferred resins are cationic resins, such as quaternary ammonium compounds described in U.S. Pat. Nos. 3,011,918 and 3,228, 770, the process thus has been limited to an application of a negative polarity only to the photoconductor. This in turn has limited the selection of photoconductor materials to those which work well in photoconductography when given a negative potential.

However, recent discoveries have led to novel photoconductor materials which, along with the more conventional photoconductors such as selenium and cadmium sulfide, work best when biased with a positive potential. Representative of such materials are certain of the "aggregate" and "multiactive" photoconductive elements, as described, respectively, in Light U.S. Pat. No. 3,615,414 and in commonly-owned U.S. application Ser. No. 534,979, filed on Dec. 20, 1974, by M. A. Berwick et al, entitled "Multi-Active Photoconductive Element I." Thus, a process which will permit photoconductography to be accomplished with a positive potential applied to the photoconductor will make a more efficient use of such photoconductive materials. Heretofore, it has been considered that such a potential would be totally inoperative when the electrolyte is cationic in nature, due to the like charges repelling each other.

Patents relating generally to the background of photoconductography include U.S. Pat. Nos. 3,010,883, 3,106,155, 3,172,826, 3,288,770, 3,425,829, 3,550,153, 3,676,116, 3,676,215 and 3,692,516, and British Pat. No. 1,006,115.

OBJECTS OF THE INVENTION

It is an object of the invention to provide a process for photoconductively attracting cationic resins to a photoconductor surface having an imagewise positive potential.

It is a related object of the invention to utilize such imagewise-attracted resins in electrographic duplication.

Other objects and advantages will become apparent upon reference to the following Summary and Detailed Description of the Preferred Embodiments, when read in light of the attached drawings.

SUMMARY OF THE INVENTION

The invention concerns a photoconductive attraction of ionic resins to a positively-biased photoconductor, whereby a negative image can be formed which is useful in electrographic copying. More specifically, there is provided a process of forming an image on a photoconductive element, at least one surface of the element having an exposable zone coextensively contacting a solution of non-photosensitive, polymeric cationic resin, the process comprising the simultaneous steps of positively biasing the photoconductive element and imagewise exposing the exposable zone to activating radiation to preferentially adhere the resin to exposed portions of the surface whereby the exposed portions of the surface having resin adhered thereto form an image. The dried image so formed can be used as a master by electrostatically charging the uncoated portions of the photoconductive element, depositing on the electrostatically charged substrate portions an electrostatically attractable developer capable of generating a visible image, whereby the developer selectively adheres only to the photoconductive substrate not coated with the resin, to form a positive image, and transferring the developer to a receiver sheet.

DESCRIPTION OF THE PREFERRED EMBODIMENTS

The invention concerns image formation by use of an electrolyte solution on a photoconductor in a photoconductive process wherein the photoconductor can be biased positively, and the electrolyte can still be a cationic resin. This is based upon the surprising discovery that a positively biased photoconductor, by some unknown mechanism, will attract a cationic resin to the exposed portions of the photoconductor surface on which the resin is coated. This phenomenon does not appear to depend on the type of photoconductor used, but it is clear it lends itself most to those photoconductors which function best in p-type conduction. The phenomenon is not a chemical reaction, because the resins and the photoconductor are preferably chemically unreactive in this process. The phenomenon does, however, require that the resin be cationic, as a negative-negative combination using anionic resins and n-type photoconductors, described below, has been found to be inoperative.

After exposure, the imagewise attracted resin can be hardened by drying. Multiple copies can be produced by repeatedly electrostatically charging the uncoated photoconductor surface, depositing a developer such as a toner, transferring to individual receiver sheets and fixing.

Figure 1:
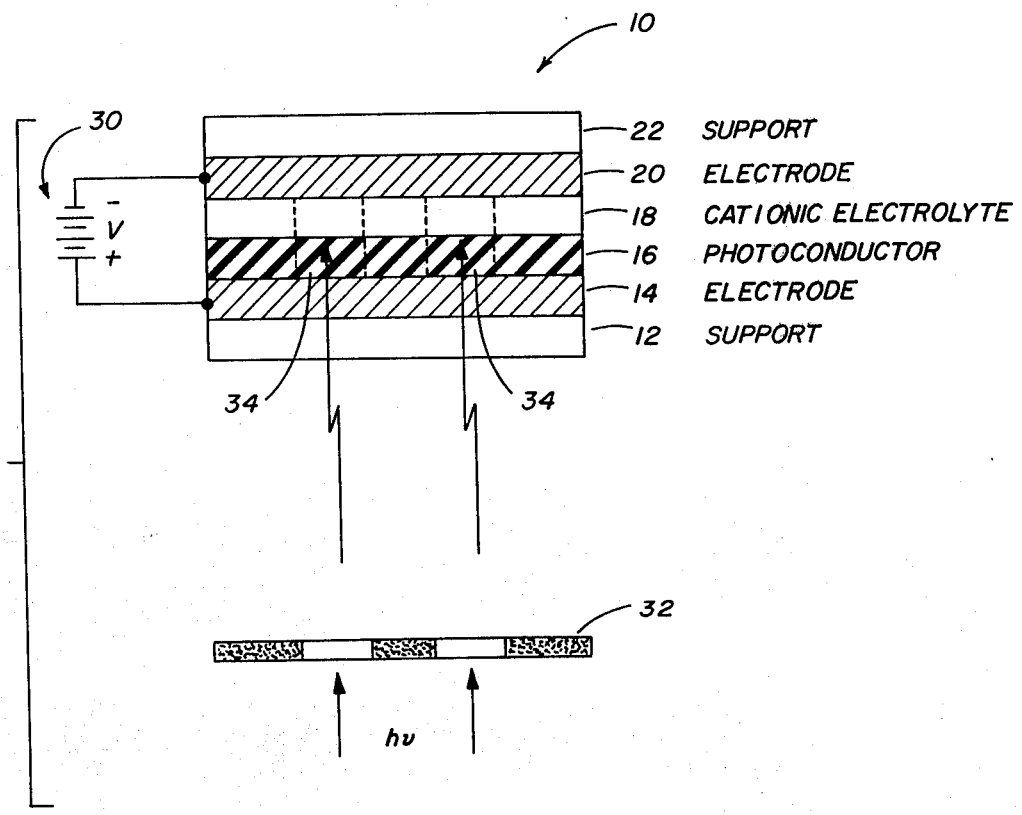
FIG. 1 is a fragmentary schematic view illustrating the photoconductive step of the invention.

FIG. 1 illustrates, partially schematically, a sandwich 10 processed in accordance with the invention. The sandwich comprises a support 12, an electrode 14, a photoconductive substrate 16, hereinafter "photoconductor", a layer 18 of the cationic resin solution, a second electrode 20, and a support 22 for the second electrode. The entire sandwich, from electrode to electrode, is biased with a voltage by means such as a power supply 30, and is exposed through a desired mask or image 32 to light radiation. As a result, an electrical current is caused to flow through exposed portions 34 of the photoconductor 16.

The supports 12 and 22 are thin transparent layers such as poly(ethylene terephthalate) film onto which semitransparent coatings of a metal electrode such as 0.4 O.D. nickel have been coated to form the electrodes 14 and 20. Alternatively, a semiconductor layer can be used as electrodes 14 and 20.

It will be readily apparent that either of the supports 12 nd 22 can be eliminated if the corresponding electrode is sufficiently thick as to be self-supporting.

Considering now the photoconductor 16, the invention does not appear to be limited to type, as satisfactory results have been observed with organic photoconductive compositions, including "non-aggregate" photoconductive compositions, "aggregate" photoconductive compositions, as described in Light, U.S. Pat. No. 3,615,414, "multi-active" photoconductive compositions as described in copending Berwick et al U.S. application Ser. No. 534,979 filed Dec. 20, 1974, and inorganic photoconductive compositions including vacuum-deposited selenium and mixtures of various inorganic photoconductors, e.g., cadmium sulfide, with an electrically insulating polymeric binder. However, overcoats placed over the photoconductor do prevent proper imagewise deposition of the resin.

Non-aggregate photoconductive compositions are organic photoconductive elements prepared by blending a dispersion or solution of a photoconductive compound, e.g., poly(vinyl carbazole) or anthracene, together with a binder, if desirable, and forming a self-supporting layer from the dispersion or solution. Additional photoconductive compounds and binders useful in such a photoconductive element are listed in *Research Disclosure*, Vol. 109, May 1973, Publication 10938, Paragraphs IV(A) and (B), respectively.

Such non-aggregate photoconductive elements can be sensitized by adding effective amounts of sensitizing compounds to exhibit improved electrophotosensitivity. Sensitizing compounds useful with the photoconductive compounds of the present invention can be selected from a wide variety of materials, including such materials as pyrylium dye salts including thiapyrylium dye materials and selenapyrylium dye salts disclosed in VanAllan et al U.S. Pat. No. 3,250,615; fluorenes, such as 7,12-dioxo-13-dibenzo(a,h)fluorene, 5,10-dioxo-4a, 11-diazobenzo(b)-fluorene, 3,13-dioxo-7-oxadibenzo(b,g)fluorene, and the like; aromatic nitro compounds of the kinds described in U.S. Pat. No. 2,610,120; anthrones like those disclosed in U.S. Pat. No. 2,670,284; quinones, U.S. Pat. No. 2,670,286; benzophenones, U.S. Pat. No. 2,670,287; thiazoles, U.S. Pat. No. 3,732,301; mineral acids; carboxylic acids, such as maleic acid, dichloroacetic acid, trichloroacetic acid and salicyclic acid, sulfonic and phosphoric acids, and various dyes, such as cyanine (including carbocyanine), merocyanine, diarylmethane, thiazine, azine, oxazine, xanthene, phthalein, acridine, azo, anthraquinone dyes and the like and mixtures thereof.

Where a sensitizing compound is employed with the binder and organic photoconductor to form a sensitized, non-aggregate containing organic photoconductive composition, it is the normal practice to mix a suitable amount of the sensitizing compound with the coating composition so that, after thorough mixing, the sensitizing compound is uniformly distributed in the coated layer. Other methods of incorporating the sensitizer or the effect of the sensitizer may, however, be employed as will be appreciated by one skilled in the art.

By "aggregate" photoconductor composition, it is meant a multi-phase organic solid containing dye and polymer such as is described in Light U.S. Pat. No. 3,615,414. The polymer forms an amorphous matrix of continuous phase which contains a discrete discontinuous phase as distinguished from a solution. The discontinuous phase is the aggregate species which is a co-crystalline complex comprised of dye and polymer. The term co-crystalline complex as used herein has reference to a crystalline compound which contains dye and polymer molecules co-crystallized in a single crystalline structure to form a regular array of the molecules in a three-dimensional pattern.

Another feature characteristic of the aggregate photoconductive composition is that the wavelength of the radiation absorption maximum characteristic of such compositions is substantially shifted from the wavelength of the radiation absorption maximum of a substantially homogeneous dye-polymer solid solution formed of similar constituents. The new absorption maximum characteristic of the aggregates formed by this method is not necessarily an overall maximum for this system as this will depend upon the relative amount of dye in the aggregate. Such an absorption maximum shift in the formation of aggregate systems for the present invention is generally of the magnitude of at least about 10 nm.

Sensitizing dyes and electrically insulating polymeric materials are used informing these aggregate compositions. Typically, pyrylium dyes, including pyrylium, bispyrylium, thiapyrylium and selenapyrylium dye salts and also salts of pyrylium compounds containing condensed ring systems such as salts of benzopyrylium and naphthopyrylium dyes are useful in forming such compositions. Dyes from these classes which can be used are disclosed in Light U.S. Pat. No. 3,615,414, as are examples of the polymeric materials and the technique for forming the co-crystalline complex. Fox U.S. Pat. No. 3,706,554 describes a useful class of aggregate photoconductors of the type described above, comprising tritolylamine, a pyrylium dye, and a polymeric material having an alkylidene diarylene moiety.

Still another useful type of photoconductor elements for this invention are "multi-active" types comprising charge-generation layer in electrical contact with an organic photoconductor containing charge-transport layer, as disclosed in commonly owned U.S. application Ser. No. 534,979, filed on Dec. 20, 1974 by Martin A. Berwick et al, entitled "Multi-Active Photoconductive Element I". The charge-generation layer of these "multi-active" photoconductor elements contain the "aggregate" type of photoconductor element described above. Preferably to render the multi-active element sensitive to visible light, the "aggregate" charge-generation layer is characterized by having its principal absorption band of radiation in the visible region of the spectrum within the range of from about 520 nm to about 700 nm.

The organic charge-transport layer used in the multiactive elements is essentially an organic composition. It is in electrical contact with the charge-generation layer and contains at least one organic photoconductor as the charge-transport material which is capable of accepting and transporting injected charge carriers from the charge-generation layer. The term "organic", as used herein, refers to both organic and metallo-organic materials. Useful charge-transport materials can generally be divided into two classes depending upon the electronic charge-transport properties of the material. That is, most charge-transport materials generally will preferentially accept and transport either positive charges, i.e. holes, or negative charges, i.e. electrons, generated by the charge-generation layer. Of course, there are many materials which will accept and transport either positive charges or negative charges; however, even these "amphoteric" materials generally, upon closer investigation, will be found to possess at least a slight preference for the conduction of either positive charge carriers or negative charge carriers. Those materials which exhibit a preference for the conduction of positive charge carriers are referred to herein as "p-type" charge-transport materials, and those materials which exhibit a preference for the conduction of negative charge carriers are referred to herein as "n-type" charge-transport materials.

Particularly useful inorganic photoconductor elements for this invention include cadmium sulfide, because it photoconducts most efficiently, or only, when polarized positively. It and other known inorganic photoconductive materials can be utilized with conventional binders, if desired, such as those published in *Research Disclosure*, Vol. 109, May 1973, Publication 10938, Paragraph V(B).

Turning now to the cationic electrolyte 18, any polymer resin having a net positive charge can be used. Preferably it should harden upon drying. Furthermore, to permit reuse with a different master image, it is further preferred that the polymer be chemically inert with respect to the photoconductor element 16, whereby the imagewise formation of the electrolyte can be erased by washing. Particularly useful examples of such polymers include quaternary ammonium homopolymers and copolymers, such as those having as the counter ion, a halogen atom. The addition of an inorganic salt to the electrolyte appears to make little difference in the performance. Table 1 below is a nonexclusive list of cationic resins which have been found to be useful, a calculated ionic charge for each being expressed in terms of electronic charge per atomic mass units, for the resin when in a water solution.

Table 1

| | Electrolyte solution | net + charge |
|---|---|---|
| 1 | 5 to 40% water solution of poly(dimethyl diallyl ammonium chloride) | +1/126 |
| 2 | No. 1 with KCl to make 10% KCl solution | +1/126 |
| 3 | 5 to 20% water solution of poly-(3-methacroyloxypropyltrimethylammonium chloride) | +1/186 |
| 4 | 10 to 30% water solution of poly-(vinylbenzyltrimethylammonium chloride | +1/176 |
| 5 | 10 to 40% water solution of a 9:1 copolymer of dimethyl diallyl ammonium chloride and diacetone acrylamide, such as Calgon 7091 | +1/143 |

The resin concentrations set forth in Table 1 are only general limits which have been found useful. Deviations are possible, so long as decreased amounts are still sufficient to coat the imaged areas, and increased amounts deposit uniformly. The thickness of the deposited electrolyte layer on the photoconductor will depend in part on the concentration of resin being used. A typical value for such a thickness can be between about 0.5 and about 50 microns.

The preferred solvent is water, as will be appreciated from the specific examples given. However, if the cationic resin is more soluble in another solvent, the latter may be used.

Although the mechanism of the process is not fully understood, apparently the chloride ion in solution is free to migrate, and the remaining portion of the polymer remains intact with a positive charge. It is this polymer portion that appears to be attracted to the exposed, current-transmitting areas of the photoconductor.

Factors which may be varied in the process of the invention include the magnitude of voltage V, FIG. 1, which is uniformly applied across the sandwich. Voltages as low as 50 volts have been found to cause imagewise deposition of the electrolyte, while the only upper limit is one which must be selected to avoid electrolysis of the resin solution. In some instances, voltages as high as 500 volts will not cause electrolysis. It will be appreciated, however, that the mechanism of photoconductography requires that the light energy be increased when the voltage is decreased. Thus, while an exposure of $5 \times 10^5$ ergs per $cm^2$ is sufficient for a voltage of 350 volts, it must be increased to about $5 \times 10^6$ ergs per $cm^2$ when the voltage is decreased to approximately the 150 volt level. The light exposure can be altered by increasing the exposure time or the intensity of the light source. Typical exposure times range from about 0.1 to about 3 minutes using a 150-watt Xenon lamp and an ultra-violet and infrared-rejection filter.

It will be appreciated that all of the layers of the sandwich must be in electrical contact with each other to perform in the manner as described above. This can be done readily by passing the sandwich through pressure rollers prior to the application of the voltage and the light exposure.

Figure 2:
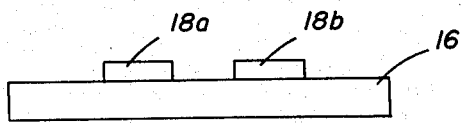
FIG. 2 is a fragmentary, enlarged, elevational view of the master image formed by the process of the invention.

FIG. 2 illustrates the resulting image pattern 18*a* of resin formed on the photoconductor 16 after the imaging process has been completed, the sandwich dismantled, nonadhered portions of the resin solution have been removed, and the adhered resin portions 18*a* dried. Typically, the nonadhered portions are lifted off the photoconductor by separating the sandwich, but, if necessary, remaining resin can be removed from nonexposed portions simply by gently wiping with damp cotton. This negative image pattern is particularly useful as a master in electrographic copying. That is, subsequently the photoconductor can be electrostatically charged such as by a corona discharge device to a potential of about −600 volts. The resin pattern appears to imagewise mask out portions of the charge which would otherwise form on the photoconductor surface. An electrostatically attractable developer is then deposited onto the charged portions of the photoconductor surface, adhering preferentially to these portions as the resin-coated portions have insufficient charge. Transfer and fixing of the developer to a receiver sheet is then achieved by conventional well-known techniques, such as those described in U.S. Pat. No. 2,297,691 and 2,551,582 and in "RCA Review", Vol. 15 (1959), pages 469–484. Any electrostatically attractable developer can be used, either in the dry or liquid form, and suitable examples and techniques are described in *Research Disclosure*, Vol. 109, May 1973, Publication 10938, Paragraphs VII–IX. After each transfer of the developed image, recharging of the photoconductor and redepositing of the developer can be used for subsequent receiver sheets, without significant degradation of the image.

After the required number of copies have been made, it is a simple matter to erase the master image by rinsing the photoconductor in the same solvent as was used in the electrolyte. The photoconductor 16 is then ready to be reused. No persistence of the first image has been found when the photoconductor is then reprocessed as shown in FIG. 1, a coating of a cationic electrolyte being again imagewise formed as before, albeit in a different pattern.

EXAMPLES

The following examples are included by way of illustration only, and are not in any way an exhaustive list of variations which can be incorporated into the process.

EXAMPLE 1

A sandwich was prepared in the manner shown in FIG. 1, with an aggregate-type photoconductor comprising a mixture of "Lexan 145" polycarbonate resin, manufactured by G.E., 40% by weight tritolylamine, and 1% by weight 4-(4-dimethylaminophenyl)-2,6-diphenylthiapyrylium fluoroborate. Useful methods of forming such aggregate-type photoconductor mixtures are described in Examples 1 and 2 of U.S. Pat. No. 3,706,554, dated Dec. 19, 1972. The electrolyte was a 20% water solution of electrolyte No. 1, Table 1, spread onto the photoconductor. The voltage V was + 350 volts, and the exposure time was 30 sec. Upon dismantling, the electrolyte separated imagewise and hardened upon drying by gentle heating. Thereafter, the photoconductor with the hardened resin in negative image form was negatively charged via a corona discharge device, and a dry toner was applied to the photoconductor using magnetic brush development. The toner was composed of a styrene copolymer, carbon black, and a charge agent. The toner adhered only to the charged portions of the photoconductor, i.e. those not covered by the resin. Subsequent transfer and fixing of the toner to a paper sheet was achieved by conventional electrophotographic techniques. After 30 identical copies were made in this fashion, it was observed that the quality of the image was good and substantially the same as the first such copy.

EXAMPLE 2

The exposure was made according to Example 1, using the photoconductor, rear electrode, electrolyte, and exposure conditions of that example. The two layers were then peeled apart and the excess conductive resin was wiped away, revealing the imagewise deposition. After the image had dried, it was submerged in warm water and washed away with gentle rubbing. No visible image remained. The same photoconductor element was then re-exposed under the former conditions, except that the imaging mask was turned 90° so that any persistence of the first image could be recognized. After the exposure, the excess resin was wiped away revealing an image of the second configuration. No patterns of the first image were evident.

EXAMPLE 3

A 20% aqueous solution of poly(vinylbenzyltrimethylammonium chloride) (No. 4, Table 1) was prepared as the electrolyte. Exposure was carried out according to Example 1 using a 100 sec light exposure and a +400 volt potential. A high quality image resulted, similar to those obtained with the electrolyte of Example 1.

EXAMPLE 4

Example 3 was repeated, except the voltage was decreased to 300 volts. A high quality image was again obtained.

EXAMPLE 5

A 20% aqueous solution of electrolyte No. 5, Table 1, was prepared. The exposure was performed according to Example 1, using a 100 sec light exposure and a +350 volt potential. A high quality image was obtained.

EXAMPLES 6–8

To demonstrate that the process of the invention will not work in the negative-negative mode, the anionic resins of Table 2 were dissolved to form an electrolyte. The theoretical net negative charge of the resins was increased by forcing the resin to further dissociate, by adding to a solution of the resin sufficient excess solid NaOH to raise the pH to 9. The percent solution of the resin shown in the Table was the amount prior to the addition of NaOH.

Table 2

| Example | Anionic Electrolyte | Theoretical net charge at pH 9 (electron charge/atomic mass unit) |
|---|---|---|
| 6 | 8% poly(acrylic acid) | −1/71 |
| 7 | 15% poly(styrene sulfonic acid) | −1/183 |
| 8 | 12% poly[2-(methacryloxy)-ethyl-phosphonic]acid | −1/202 |

The sandwich was prepared as shown in FIG. 1 for each of the electrolytes, except that the polarity of the power supply 30 was reversed. The aggregate photoconductor element used in Example 1 can also be used as an n-type photoconductor. Four hundred volts were applied during a 200 second exposure. No imagewise deposition or attraction was observed for any one of these three anionic resins.

EXAMPLE 9

The photoconductive element bearing the neutralized poly(styrene sulfonic acid) solution, prepared as described in Example 7, was exposed with a positive potential on the photoconductor to show that this electrolyte resin is capable of electrophoretic imaging, that is, will be imagewise attracted by the conventional method of applying a potential of opposite sign (+) to the photoconductor. A photoconductor sandwich similar to that of Example 7 was used with the exception that the nickel electrode was replaced with a rear electrode of CuI semi-conductor in a binder of poly(vinyl butyral), overcoated with a thin gelatin layer. A +600 volt potential was applied during a 100 second exposure. A good image was obtained.

Therefore, it must be concluded that there is something peculiar to the positive-positive combination of the invention which permits imagewise attraction.

The invention has been described in detail with particular reference to certain preferred embodiments thereof, but it will be understood that variations and modifications can be effected within the spirit and scope of the invention.

What is claimed is:

1. A process of forming an image on a photoconductive element, at least one surface of the element having an exposable zone coextensively contacting a solution of non-photosensitive, polymeric, cationic resin, the process comprising the simultaneous steps of positively biasing the photoconductive element to establish a substantially uniform field across the element and resin solution; and imagewise exposing the exposable zone to activating radiation to preferentially adhere the resin to exposed portions of the surface whereby said exposed portions form an image.

2. The process as defined in claim 1 wherein said element and said resin are chemically unreactive in said process.

3. The process as defined in claim 1 wherein said resin is a homopolymeric or a copolymeric quaternary ammonium resin.

4. The process as defined in claim 3 wherein said resin is selected from the group consisting of poly(3-methacryoyloxypropyltrimethylammonium chloride), homopolymers of dimethyl diallyl ammonium chloride, and copolymers of dimethyl diallyl ammonium chloride and diacetone acrylamide.

5. A process of forming an image on a photoconductive element, one surface of the element having an exposable zone coextensively contacting a solution of non-photosensitive, polymeric, cationic resin, the process comprising the simultaneous steps of positively biasing the photoconductive element to establish a substantially uniform field across the element and resin solution;

imagewise exposing the exposable zone to activating radiation to preferentially adhere the resin to exposed portions of the surface whereby said exposed portions form an image; and removing the non-adhered portions of said resin, so as to leave the remaining adhered portions of the resin as the image.

6. The process as defined in claim 5 wherein said element and said resin are chemically unreactive in said process.

7. The process as defined in claim 5 and further including the subsequent step of drying said remaining resin to form a durable image.

8. The process as defined in claim 7 and further including the subsequent steps of electrostatically charging the portions of the photoconductive element to which the resin is not adhered;

depositing on the electrostatically charged element portions an electrostatically attractable developer capable of generating a visible image, whereby the developer selectively adheres only to the photoconductive element not coated with the resin, to form an image; and transferring said developer to a receiver sheet.

9. The process as defined in claim 10 and further including the subsequent step of washing away the image-forming resin in a solvent rinse, whereby a fresh layer of resin may be formed on the element for a new image.

10. The process as defined in claim 5 wherein said biasing comprises the step of applying a voltage across the resin and element, said voltage being between about 50 volts and, as the upper limit, that which is sufficient to cause electrolysis of the resin solution.

11. The process as defined in claim 5 wherein the voltage is between about 50 and about 500 volts.

* * * * *